US006120182A

United States Patent [19]

Koock

[11] Patent Number: 6,120,182

[45] Date of Patent: Sep. 19, 2000

[54] APPARATUS FOR CONTAINING NATURAL FIBER

[76] Inventor: James Timothy Koock, P.O. Box One, Fredricksburg, Tex. 78624

[21] Appl. No.: 09/212,848

[22] Filed: Dec. 16, 1998

[51] Int. Cl.[7] ..... B65D 33/16

[52] U.S. Cl. ..... 383/99; 383/102; 383/109; 206/83.5

[58] Field of Search ..... 150/154; 206/83.5; 383/98, 99, 102, 106, 109, 119, 120, 124

[56] References Cited

U.S. PATENT DOCUMENTS

| | | | |
|---|---|---|---|
| 0,152,560 | 6/1874 | King . | |
| 179,745 | 7/1876 | Blake | 383/18 X |
| 0,443,619 | 12/1890 | Orr . | |
| 0,443,620 | 12/1890 | Orr . | |
| 0,496,042 | 4/1893 | Dederick . | |
| 1,574,885 | 3/1926 | Henne . | |
| 1,726,523 | 9/1929 | Blows | 383/98 X |
| 2,971,643 | 2/1961 | Farley . | |
| 3,547,754 | 12/1970 | Tokos et al. | 383/32 X |
| 3,906,591 | 9/1975 | Boiardi . | |
| 4,235,365 | 11/1980 | Yoshii et al. | 383/32 X |
| 4,538,385 | 9/1985 | Kandarian | 150/154 |
| 4,712,672 | 12/1987 | Roy et al. | 206/83.5 |
| 4,746,011 | 5/1988 | McNair et al. | 206/83.5 |
| 5,035,323 | 7/1991 | Daniels et al. . | |
| 5,632,558 | 5/1997 | Baker | 206/83.5 X |
| 5,904,243 | 5/1999 | Porter | 150/154 X |

FOREIGN PATENT DOCUMENTS

| | | | |
|---|---|---|---|
| 12269 | 7/1933 | Australia | 206/83.5 |
| 563497 | 6/1960 | Belgium | 150/154 |
| 843259 | 6/1970 | Canada | 206/83.5 |
| 1494759 | 4/1967 | France | 206/442 |
| 149491 | 7/1981 | Germany | 383/99 |
| 306514 | 1/1937 | Italy | 383/18 |
| 207134 | 12/1980 | New Zealand . | |
| 971973 | 10/1964 | United Kingdom | 383/32 |
| 1266390 | 3/1972 | United Kingdom | 383/99 |

OTHER PUBLICATIONS

Texas A&M Research & Extension Center photographs, taken Jul. 22, 1998; the prior art indicated in photographs 2 and 3 was in general use in wool industry prior to Dec. 16, 1997, No author for prior art.

*Primary Examiner*—Jes F. Pascua
*Attorney, Agent, or Firm*—Fulbright & Jaworski L.L.P.

[57] ABSTRACT

An apparatus for containing natural fiber comprising a flexible shell and one or more straps secured to an outer surface of the shell for cinching the shell closed. The shell preferably comprises low-density polyethelene, and an openable end to allow access inside the shell. The shell may be substantially transparent to allow for viewing of the contents of the apparatus. The openable end of the shell may comprise four flaps, wherein the straps hold the flaps closed when the straps are cinched. The shell may have a generally hexahedral shape when full of wool and cinched closed. The shell may comprise gussets built into the end opposite to the openable end for maintaining the opposite end in a generally rectangular shape. The straps preferably comprise woven polyester. Each of the straps may comprise a free end and a loop at the other end, whereby a half-hitch can be tied to the loop using the free end. The shell and straps are preferably made of relatively inexpensive, recycleable materials, and no potentially dangerous metal hooks are used to close the apparatus.

18 Claims, 3 Drawing Sheets

APPARATUS FOR CONTAINING NATURAL FIBER

CROSS-REFERENCE TO RELATED APPLICATION

This application is related to co-owned and co-filed U.S. Design patent application Ser. No. 29/097,883 James Timothy Koock, "A Package for Natural Fiber," which is hereby incorporated herein by reference.

TECHNICAL FIELD

This invention relates to a packaging apparatus, and more particularly to an apparatus for containing natural fiber.

BACKGROUND

Woolpacks are used extensively in the wool industry to package sheared wool for storage and shipping. Generally between about 400 and 500 pounds, and typically about 450 pounds, of wool can be mechanically compressed into a typical woolpack, which is box-like in shape and has four flaps at one end. Once filled with wool, two of the flaps are closed, and three to four metal hooks are used to hold the flaps closed. Three to four more hooks then are used to hold the remaining two flaps closed. Referring to the drawing, and in particular to FIG. 1, prior art hook 30 has very sharp points 32, which can be dangerous to people who work with the woolpacks or to people coming in contact with improperly stored or disposed hooks.

Prior art woolpacks are traditionally made out of woven high-density polyethelene. A problem with this material is that it is not recycleable, and woolpacks made of this material are becoming unacceptable in many countries of the world.

Another woolpack recently developed to comply with the new recycling requirements is made of woven nylon, a recycleable material. This material, however, makes these woolpacks approximately twice as expensive as the woven high-density polyethelene woolpacks. In addition, woven nylon woolpacks are still closed by the traditional method of securing the flaps with sharp metal hooks.

SUMMARY OF THE INVENTION

It is therefore an object of the present invention to provide an apparatus for containing natural fiber, such as sheared wool, that overcomes deficiencies in prior art woolpacks.

It is an object of the present invention to provide an apparatus for containing natural fiber which does not use the potentially dangerous hooks of prior art woolpacks.

It is an object of a preferred embodiment of the present invention to provide an apparatus for containing natural fiber which is relatively inexpensive and recycleable.

These and other objects, features and technical advantages are achieved by one aspect of the present invention, an apparatus comprising a flexible shell and one or more straps secured to an outer surface of the shell for cinching the shell closed. The shell preferably comprises low-density polyethelene and the straps preferably comprise woven polyester. The shell may comprise an openable end to allow access inside the shell, and may be substantially transparent to allow for viewing of the contents of the apparatus.

According to another aspect of the present invention, the openable end of the shell may comprise four flaps, and the straps may hold the flaps closed when the straps are cinched.

According to another aspect of the present invention, the shell may have a generally hexahedral shape when full of natural fiber and cinched closed. The shell may comprise gussets built into the end opposite to the openable end for maintaining the opposite end in a generally rectangular shape.

According to another aspect of the present invention, each of the straps may comprise a free end and a loop at the other end, whereby a half-hitch may be tied to the loop using the free end. The apparatus may be recloseable. According to yet another aspect of the present invention, the shell may comprise micro-vents.

Accordingly, it is an advantage of the present invention that no potentially dangerous metal hooks need be used to close the apparatus.

An advantage a preferred embodiment of the present invention is that it may be closed fast and easily, and it may securely contain compressed natural fiber.

Another advantage of a preferred embodiment of the present invention is that the shell and straps may be made of relatively inexpensive, recycleable materials.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION OF THE PREFERRED EMBODIMENTS

Figure 1:
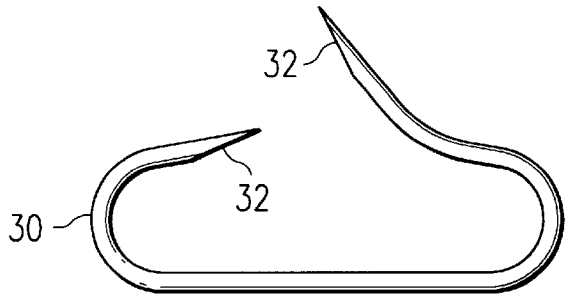
FIG. 1 (PRIOR ART)
FIG. 1 shows a metal hook used in prior art woolpacks.
Figure 2:
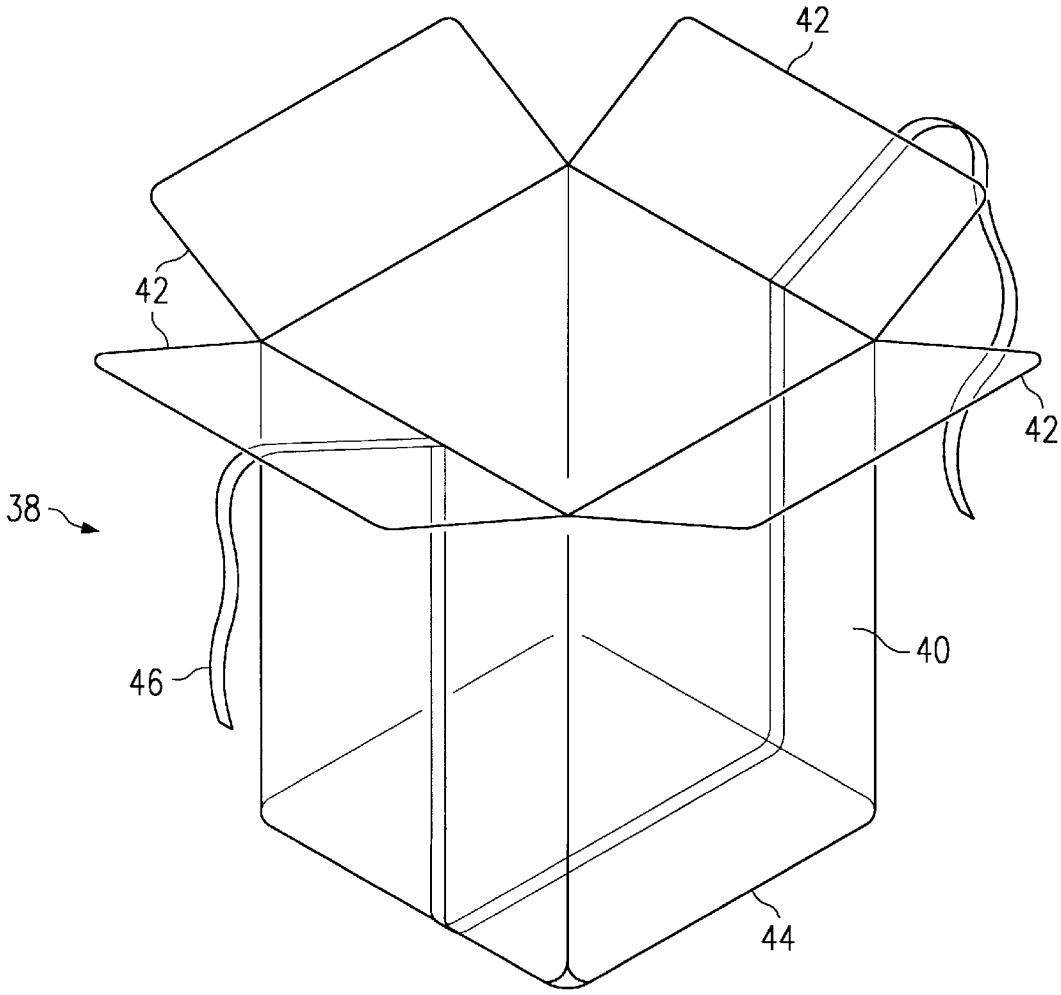
FIG. 2 is a perspective view of an empty apparatus according to the present invention.

Referring again to the drawing, and in particular to FIG. 2, there is shown an embodiment of the present invention, empty apparatus 38. Apparatus 38 comprises two primary components, shell 40 and strap 46. Shell 40 preferably comprises low-density polyethelene, a recycleable, non-contaminating and relatively inexpensive material which is available on the general market. Overall, apparatus 38 of this embodiment is generally only about one-third the cost of a prior art woven nylon woolpack.

There are many other advantages to using low-density polyethelene. It may be made transparent, which beneficially permits viewing of the contents of apparatus 38 for identification or quality purposes. Although shell 40 is not as transparent to light as, for example, glass, it does transmit sufficient light to allow easy viewing of the contents. Alternatively, shell 40 may comprise opaque, colored, plain or printed low-density polyethelene, depending on the requirements of a specific application. Shell 40 may also be stenciled and marked as is generally done with traditional woolpacks.

In addition, the low-density polyethelene of shell 40 is very durable—it is about twice as strong as traditional woolpack materials, and it is puncture, tear and fibrillation resistant. While about 8 mils thickness is the most preferred embodiment, a thickness of greater or less than 8 mils, such as between 6 and 9 mils, or between 4 and 16 mils, may be used as an alternative. Shell 40 may also include micro-vents (not shown) for breathability and moisture release. Micro-vents are preferably small (e.g., about 1/32 inch diameter) pores or holes located at approximately every square inch of shell 40, although many other hole patterns and hole diameters may be used in accordance with the present invention. Furthermore, stacking of multiple apparatus 38 may be done without anti-skid adhesives because the low-density polyethelene of shell 40 generally inherently inhibits the sliding of one layer against another layer.

While shell 40 preferably comprises transparent low-density polyethelene, other materials are within the scope of the present invention, and the actual implementation of low-density polyethelene itself may be accomplished in various ways. For example, as used herein, "low-density polyethelene" is defined as including both non-linear and linear low-density polyethelene. "Linear" generally means that the molecules in extruded polyethelene material are aligned to provide increased strength to the material, and may be accomplished with the proper application of heat during the extrusion process.

Shell 40 is preferably tri-extruded from three layers: an outer layer of low-density polyethelene, a middle layer of a low-density/high-density polyethelene mixture, and an inner layer of low-density polyethelene. Alternatively, shell 40 may be single extruded from one layer of low-density polyethelene. As yet another alternative, shell 40 may be co-extruded from two layers, such as an outer layer of low-density polyethelene and an inner layer of low-density polyethelene. In the above embodiments, the low-density polyethelene layers are preferably a non-linear/linear low-density polyethelene mixture. Additionally, the amount of high-density polyethelene used in the above embodiments does not prevent shell 40 from being recyclable. While shell 40 is preferably made of a recycleable material, there may be applications in which non-recycleable material is acceptable.

Other combinations of the above materials may be used, and additives, such as various resins and metals, may be added to the material to change the characteristics of shell 40 as desired. When shell 40 is extruded from more than one layer, each layer may have different resins or metals added to it to tailor the characteristics to the requirements of that layer. For example, adding resins to a layer modifies the surface of the layer to provide a rough, textured surface. This modified surface is resistant to abrasions, tears and punctures. When used in the inner layer, the texturing on the modified surface generally helps to hold down the natural fiber as it is compressed into apparatus 38. When used in the outer layer, the modified surface generally facilitates the removal of apparatus 38 from a press, because there is less surface area of shell 40 in contact with the walls of the press.

One end of shell 40 is openable and has four flaps 42 that allow access to inside apparatus 38. The end may be any side or portion of any side of shell 40. Alternatively, other opening and/or flap configurations, such as different flap shapes or quantities, may be used. At the opposite end of apparatus 38, bottom end 44 is generally rectangular in shape to cause shell 40 to have a generally hexahedral or box-like shape when apparatus 38 is full of natural fiber. There are many natural fibers that may be stored in apparatus 38, such as fleece, wool, mohair, alpaca, vicuna, and cotton. Bottom end 44 is considered only generally rectangular in shape and shell 40 is considered only generally hexahedral in shape because of, for example, the flexibility of the shell 40 material, the rounding of corners, and the deformations made by straps 46.

In a typical operation, apparatus 38 is placed inside a rigid outer container with approximately the same dimensions as apparatus 38. Natural fiber is then mechanically compressed into apparatus 38 until it is full. Alternatively, natural fiber may be placed into apparatus 38 by hand, although this method is generally less efficient and packs substantially less material into apparatus 38. Flaps 42 are folded over to close apparatus 38, and strap 46 is then cinched to securely hold flaps 42 closed.

Strap 46 is preferably made of woven polyester, another recycleable material. Woven polyester is very strong and durable-generally it has about 1000 pounds of tensile strength per strap 46 and is fibrillation resistant. Alternatively, strap 46 may be made of nylon or polypropylene. Combinations of materials may be used, and additives, such as various resins and metals, may be added to the material to change the characteristics of strap 46 as desired. While it is preferable for strap 46 to be made of a recycleable material, there may be applications in which non-recycleable material is acceptable. For ease of use, strap 46 is pre-attached to the outer surface of shell 40 before it is filled with natural fiber, and strap 46 encircles shell 40 to reinforce it against the pressure of the compressed natural fiber inside.

Preferably, strap 46 is attached using sections or strips of rubber adhesive tape 58 (FIG. 6) that are, for example, 2 inches wide by 3–4 inches long. The rubber adhesive tape works over a wide range of temperatures, generally about 0–140° F. Advantageously, the rubber adhesive tape sticks very well to shell 40, but not as well to strap 46. Thus when strap 46 is pulled on, it tends to come loose from under the tape, permitting strap 46 to be cinched tight around shell 40. Pulling on strap 46 effectively forms a channel or sleeve under the rubber adhesive tape through which strap 46 may slide.

Alternatively, strap 46 may be attached to shell 40 by other methods, such as with glue or heat-welding. As another alternative, loops may be formed as part of or attached to shell 40, through which strap 46 may be fed and secured to shell 40. While it is preferable for strap 46 to be pre-attached to shell 40, in an alternative embodiment strap 46 may not be attached at all. In addition, strap 46 may not completely encircle shell 40, and these and other embodiments are considered to be within the scope of the present invention.

Note that in FIG. 2 only one strap 46 is shown for clarity, but multiple straps are generally used to secure flaps 42. In FIG. 2, strap 46 is defined as an east-west strap because it encircles shell 40 in a left-right manner from the viewer's perspective. A strap that encircles shell 40 in a front-to-back manner from the viewer's perspective is defined as a north-south strap.

Figure 3:
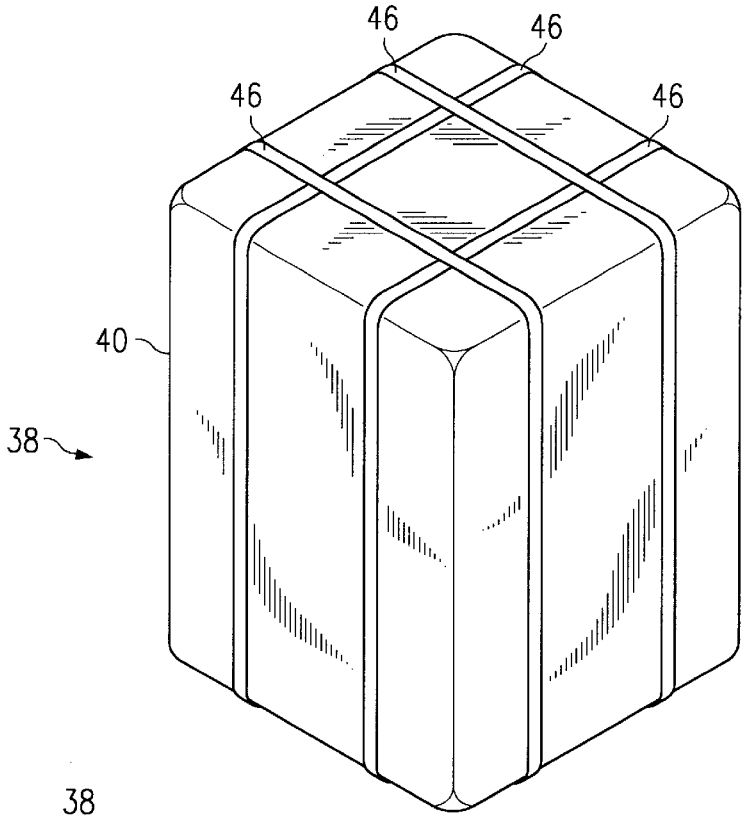
FIG. 3 a perspective view of a full apparatus cinched closed with straps.

With reference now to FIG. 3, there is shown full apparatus 38, in which shell 40 is cinched closed by straps 46. In FIG. 3, four straps 46 are used, two east-west straps and two north-south straps. Straps 46 enable shell 40 to be quickly and easily cinched closed even though the contents are under pressure from being compressed. Straps 46 also provide reinforcement for shell 40 by completely encircling it.

Many other strap combinations may be used and still be within the scope of the present invention For example, there may be three north-south straps and one east-west strap, or vice versa. As another example, there may be two north-south straps and one east-west strap, or vice versa. As yet another example, there may be three north-south straps and two east-west strap, or vice versa.

Figure 4:
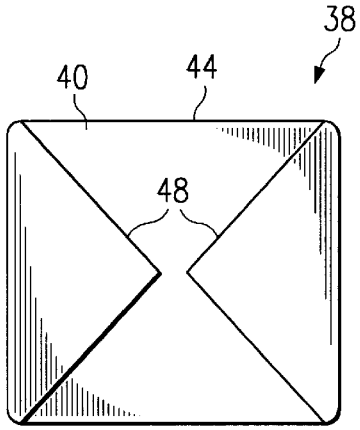
FIG. 4 is bottom view of an apparatus comprising gussets.

Referring now to FIG. 4, there is shown bottom end 44 of apparatus 38. In FIG. 4, shell 40 is shown with gussets 48 which reinforce bottom 44 and assist in forming the generally rectangular shape of bottom end 44. This rectangular shape in turn causes shell 40 to have a generally hexahedral shape when packed full of natural fiber. Alternatively, bottom end 44 may have a different shape, such as exactly square, or rounded or circular, and the shape of shell 40 when full of natural fiber would in turn be modified by the different shape of bottom end 44.

Figure 5:
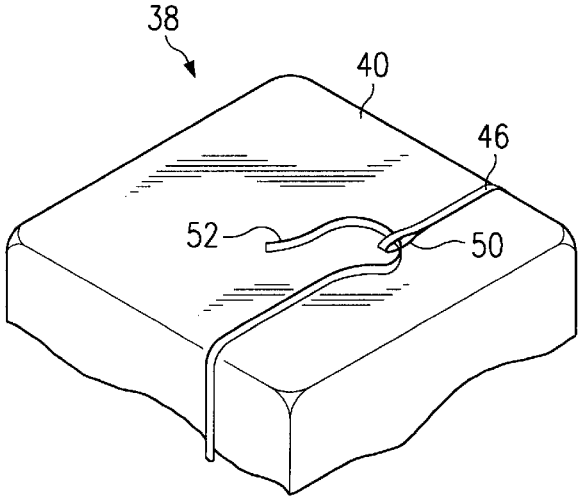
FIG. 5 is a perspective view of the top of an apparatus showing a strap in the process of being cinched.

With reference now to FIG. 5, there is shown a partial view of apparatus 38 in which strap 46 in the process of being cinched tight around shell 40. Again, only one strap is shown in the figure for clarity. Strap 46 has loop end 50 and free end 52. To quickly and easily cinch strap 46, after shell 40 is full, free end 52 is fed through loop end 50, pulled tight and tied off with a half-hitch. An advantage to this simple knot is that it is secure, yet may be untied and retied fairly easily to permit apparatus pack 38 to be opened and reclosed if desired. By using straps 46, no potentially dangerous hooks 30 are needed on apparatus 38. Alternatively, straps with different ends, such as two free ends or two loop ends, may be used. In addition, any other kind of knot or securing method, such as hook and loop fasteners, may be used to attach the two ends of straps 46 together or to shell 40. Furthermore, one strap may be made longer than the others by, for example, about 8–12 inches, to provide a handle to use for leverage in moving apparatus 38. The longer strap may have a loop at the extended end for ease in holding. This has an advantage over the prior art in that loading hooks which can puncture and tear shell 40 may not be needed.

Figure 6:
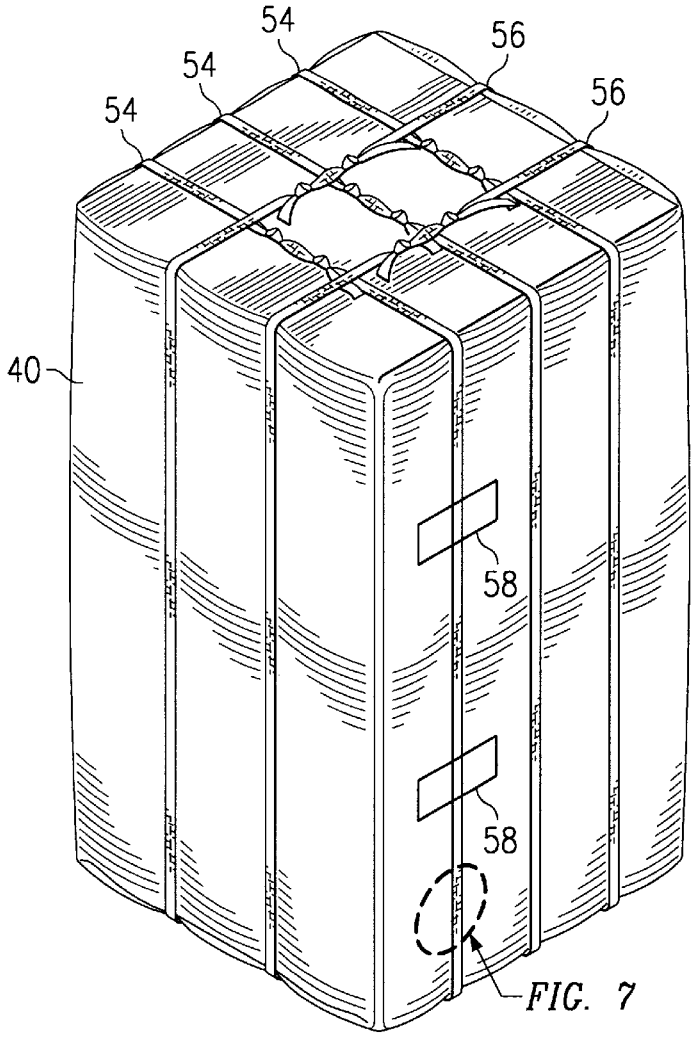
FIG. 6 is a perspective view of an apparatus showing three north-south straps and two east-west straps.
Figure 7:
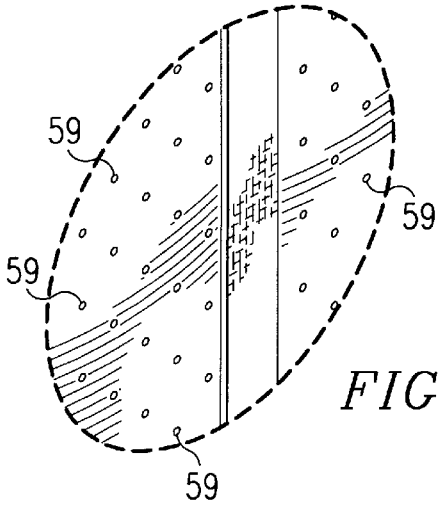
FIG. 7 is a close up view of a section of the apparatus from FIG. 6 illustrating micro-vents.

With reference to FIG. 6, there is shown a preferred embodiment of the invention with three north-south straps 54 and two east-west straps 56 cinched around shell 40. FIG. 7 is a close up view of a section of the embodiment from FIG. 6 illustrating micro-vents 59 in shell 40.

Although the present invention and its advantages have been described in detail, it should be understood that various changes, substitutions and alterations can be made herein without departing from the spirit and scope of the invention as defined by the appended claims.

What is claimed is:

1. An apparatus for containing natural fiber, said apparatus comprising:

a flexible shell for holding said fiber, said shell comprising an openable end to allow access inside said shell, wherein said openable end of said shell comprises four flaps; and one or more straps pre-attached to and encircling an outer surface of said shell for cinching said shell closed, wherein said straps reinforce said shell and hold said flaps closed and overlapping when said straps are cinched and wherein each of said straps further comprises a free end and a loop at another end, whereby a half-hitch can be tied to the loop using the free end of the strap.

2. The apparatus of claim 1 wherein said shell has a generally hexahedral shape when full of said natural fiber and cinched closed.

3. The apparatus of claim 1 wherein said shell comprises gussets built into an opposite end to said openable end, said gussets for maintaining said opposite end in a generally rectangular shape.

4. The apparatus of claim 1 wherein said straps are attached to said shell with sections of rubber adhesive tape.

5. The apparatus of claim 1 wherein said one or more straps consist of three north-south straps and two east-west straps.

6. The apparatus of claim 1 wherein said apparatus is recloseable.

7. The apparatus of claim 1 wherein said shell is transparent.

8. The apparatus of claim 1 wherein said shell is between approximately six and nine mils thick.

9. The apparatus of claim 1 wherein said shell comprises low-density polyethelene.

10. The apparatus of claim 9 wherein said shell is tri-extruded.

11. The apparatus of claim 1 wherein said one or more straps comprise woven polyester.

12. The apparatus of claim 1 wherein said shell comprises micro-vents.

13. An apparatus for containing natural fiber, said apparatus comprising:

a flexible shell comprising linear low-density polyethelene, said shell comprising an openable end to allow access inside said shell;

one or more straps comprising woven polyester, said straps secured to an outer surface of said shell for cinching said shell closed, wherein said shell and said straps are recyclable; and said shell further comprises non-linear low-density polyethelene, wherein said shell is co-extruded from a first layer of said linear low-density polyethelene and a second layer of said non-linear low-density polyethelene.

14. The apparatus of claim 13 wherein said openable end of said shell comprises four flaps, wherein said straps hold said flaps closed and reinforce said shell when said straps are cinched.

15. The apparatus of claim 13 wherein said straps are attached to said shell with sections of rubber adhesive tape.

16. The apparatus of claim 13 wherein said shell comprises micro-vents.

17. An apparatus for containing natural fiber, said apparatus comprising:

a flexible shell comprising low-density polyethelene, said shell comprising an openable end with four flaps to allow access inside said shell; and one or more straps comprising woven polyester, said straps encircling said shell and pre-attached to an outer surface of said shell with sections of rubber adhesive tape, said straps for cinching said shell closed and reinforcing said shell, wherein each of said straps comprises a free end and a loop at another end, and wherein said shell and said straps are recyclable.

18. The apparatus of claim 17 wherein an outer surface of said shell is modified to have a rough, textured surface.

* * * * *